US006051081A

United States Patent [19]

Valle Echevarria et al.

[11] Patent Number: 6,051,081

[45] Date of Patent: Apr. 18, 2000

[54] AUSTENITIC-FERRITIC STEEL OF THE SUPERDUPLEX TYPE APPLICABLE TO THE FABRICATION OF SEAMLESS TUBES

[75] Inventors: Javier Valle Echevarria; Jose Manuel Gerrero de la Serna, both of Amurrio, Spain

[73] Assignee: Tubacex, S.A., Llodio, Spain

[21] Appl. No.: 09/101,205

[22] PCT Filed: Oct. 29, 1996

[86] PCT No.: PCT/ES96/00201

§ 371 Date: Jun. 29, 1998

§ 102(e) Date: Jun. 29, 1998

[87] PCT Pub. No.: WO98/18974

PCT Pub. Date: May 7, 1998

[51] Int. Cl.[7] ..... C22C 38/44

[52] U.S. Cl. ..... 148/325; 420/64; 420/65; 420/67

[58] Field of Search ..... 148/325; 420/64, 420/65, 67

[56] References Cited

FOREIGN PATENT DOCUMENTS 534864 3/1993 European Pat. Off. .

683241 11/1995 European Pat. Off. .

2228119 11/1974 France .

OTHER PUBLICATIONS

Patent Abstract of Japan, vol. 18, No. 344 (C–1218) Jun. 29, 1994 & JP, 06081037 A (Sumitomo Metal Ind. LTd) Mar. 22, 1994.

*Primary Examiner*—Deborah Yee
*Attorney, Agent, or Firm*—Helfgott & Karas PC.

[57] ABSTRACT

This steel is applicable for making seamless tubes with a high mechanical strength, high pitting resistance and a high hot-formability, by means of a process comprising melt-down in an electric-arc furnace, refining in an AOD converter, ascensional ingot casting and Gothic section billet rolling, and then transforming the billet obtained into seamless tubes by upsetting the gothic billet into a round followed by hot piercing in a vertical press, tube extrusion in a horizontal press, reduction in a stretch reduction mill and Pilger cold-rolling, and having a composition of not more than 0.02% C, 0.65 to 0.85% Mn, 0.40 to 0.60% Si, 25.2 to 25.6% Cr, 6.2 to 6.6% Ni, 3.6 to 3.8% Mo, 0.24 to 0.30% N, not more than 0.025% P, not more than 0.002% S, with no Cu and W, and with the addition of a percentage of B ranging between 0.0015 to 0.0030% and a percentage of Ca ranging between 0.0010 to 0.0050%.

2 Claims, No Drawings

AUSTENITIC-FERRITIC STEEL OF THE SUPERDUPLEX TYPE APPLICABLE TO THE FABRICATION OF SEAMLESS TUBES

This application is a 371 of PCT/ES96/00201 dated Oct. 29, 1996.

OBJECT OF THE INVENTION

The invention relates to superduplex austenitic-ferritic stainless steel, applicable in means requiring materials having a high mechanical strength, high pitting resistance, good intergranular corrosion behaviour and a high hot-formability to allow tubes to be made without hot- or cold-welding.

BACKGROUND OF THE INVENTION

Austenitic-ferritic stainless steel alloys are well-known since the 1930s and 1940s and are essentially based on compositions with a high chromium, nickel and molybdenum content. Reference could in this sense be made to U.S. Pat. No. 2,432,616, applied for in 1945 by FRANKS et al., which relates to alloys with a high mechanical strength at high temperatures, one of the alloys disclosed consisting of not more than 0.35% carbon, not more than 2.0% manganese, not more than 1.0% silicon, 2–40% nickel, 10–30% chromium, 1–5% molybdenum, not more than 0.25% nitrogen, 0.5–5–0% tungsten and 0.1–0.7% boron.

Steels of this kind have evolved over the years, changing their structure to adapt to the various needs required of materials as regards mechanical strength, corrosion resistance, good structural stability and the like. In this sense, duplex and superduplex steels are well-known and used. Duplex (ferritic-austenitic) steels have a composition with a chromium percentage of 22%, 5% nickel, 3% molybdenum and 0.17% nitrogen, which gives them a good corrosion resistance in marine and similar environments. The composition of superduplex steels, on the other hand, is 25% chromium, 6.8% nickel, 3.7% molybdenum and 0.27% nitrogen, to reach a rate of pitting resistance in excess of 40. The increased percentages of chromium, nickel and molybdenum used over duplex steels provides such enhanced properties as mechanical strength and corrosion resistance.

It is moreover normal for the standard compositions of duplex and superduplex alloys to include other elements, albeit in smaller quantities, such as manganese, sulphur, silicon, copper, tungsten, magnesium, aluminium, rare earths and the like.

Reference can in this sense be made to a number of duplex or superduplex Patents in which some of the components vary over the usual standards in order to enhance a particular characteristic thereof, generally associated with a specific application of the resultant steels, namely for instance:

GB Patent 2 160 221 to NIPPON KOKAN K.K. relates to a ferritic-austenitic stainless steel for making seamless tubes with an enhanced impact toughness, therefore disclosing the addition of soluble aluminium in a quantity not exceeding 0.02%. The other components lie approximately within the usual ranges of ferritic-austenitic steels of this kind.

U.S. Pat. No. 4,604,887 to OHTSUBO et al. relates to a manufacturing method which avoids surface defects, along with flaws at the head and tail of the tubes, due to special rolling conditions and a special chemical composition, which is essentially distinguished from other duplex steels by a high copper content and the addition of small quantities of aluminium.

European Patent 0 339 004 to SANDVIK AG relates to an austenitic-ferritic stainless steel which includes tungsten, vanadium and cerium in the alloy to provide the resultant steel with high resistance in chloride ion environments and preferably applicable for manufacturing medical implants. A steels of similar characteristics is also described in European Patent 0 220 141 to SANTRADE LTD.

GB Patent 2 203 680 to NIPPON YAKIN KOGYO CO. LTD. relates to a process for continuously making ferritic-austenitic stainless steel, to which end considerable quantities of tungsten and vanadium are added, along with very small quantities of boron, the other elements lying within the usual percentages.

European Patent no. 0 545 753 to SUMITOMO METAL INDUSTRIES LTD. relates to a superduplex steel of high mechanical strength and corrosion resistance, albeit with a very reduced tendency towards intermetallic precipitation, the main characteristic of the alloy disclosed being the addition of higher than usual tungsten percentages, for the quantities of tungsten and chromium may thus be reduced and consequently so may the negative effects of these elements as regards the precipitation of the intermetallic compounds be minimised. Small quantities of other elements such as vanadium, calcium, magnesium, boron or rare earths are also added to improve the hot-ductility of the resulting steel.

European Patent no. 0 594 935 to CENTRO SVLUPPO MATERIALI S.p.A. relates to a stainless steel alloy and the respective process for obtaining seamless tubes, based on the aforesaid alloy, useful in acid environments, namely for instance in oil exploration. The alloy subject of this invention is essentially characterised by the addition of greater than usual tungsten and copper percentages, in order to improve the mechanical and corrosion resistance properties.

European Patent no. 0 566 814 to FORONI S.p.A. relates to a superduplex steel with a high corrosion resistance in an acid or alkaline environment, for which purpose greater than usual quantities of copper and tungsten are added.

DESCRIPTION OF THE INVENTION

The present invention relates to a superduplex steel alloy that retains its mechanical strength and corrosion resistance characteristics and is characterised by having a high ductility which allows tubes to be rapidly, simply and cheaply both hot- and cold-formed. Two elements are therefore added which are not usual in standard steels of this kind, namely boron and calcium, in suitable proportions in order to achieve the required ductility, moreover optimising the percentages of the other alloy components in order to retain a good mechanical strength and a high pitting resistance. This adjusted composition results in the cost of obtaining this steel being reduced, for there is no need to add other elements, some of which are very expensive, such as tungsten, copper, magnesium, vanadium or rare earths such as cerium.

An important characteristic of the steel disclosed lies in that no copper is added to the alloy, which has been possible due to the rest of the elements involved in its composition having been optimised without thereby losing the properties characteristic of steels of this kind.

More specifically, the stainless steel subject of the invention is characterised by the following composition:

C: not more than 0.02%

Mn: 0.65÷0.85%

Si: 0.40÷0.60%

Cr: 25.2÷25.6%

Ni: 6.2÷6.6%

Mo: 3.6÷3.8%

N: 0.24÷0.30%

P: not more than 0.025%

S: not more than 0.002%

B: 0.0015÷0.0030%

Ca: 0.0010/0.0050% the rest of the alloy being obviously iron and other unintentionally added impurities. A steel with this composition not only has a good mechanical strength (yield strength >600 Mpa), high pitting resistance (CPT >60°, as per ASTM G48) and a good intergranular corrosion behaviour, but presents a high hot-formability as its main characteristic, resulting from the addition of boron and calcium.

The addition of considerable quantities of boron and calcium provides the alloy subject hereof with a high hot-ductility, which makes it especially suitable for a specific integrated manufacturing process, from steel meltdown to finally hot- or cold-forming a seamless tube with a diameter size of up to 240 mm.

Furthermore, the composition described for the alloy subject hereof allows good corrosion resistance properties to be obtained, and it is thus especially suitable to be used in corrosive environments, such as sea water.

This alloy has been especially developed for obtaining seamless tubes, working a specific manufacturing process which includes the following stages:

Meltdown in an electric-arc furnace

Refining in an AOD converter

Ascensional ingot casting

Gothic section billet rolling.

The billet obtained is then transformed into a seamless tube in accordance with the following manufacturing stages:

Upsetting of the gothic billet into a round followed by hot piercing in a vertical press Tube extrusion in a horizontal press Reduction in a stretch reduction mill Pilger cold-rolling.

Tests carried out with this type of austenitic-ferritic steel have confirmed that the tubes obtained in accordance with the aforesaid manufacturing process have such good as mechanical strength, pitting resistance and hot-formability, which makes them especially suitable for making seamless tubes of any diameter used in oil exploration in marine environments or for making equipment for the chemical or petrochemical industry.

We claim:

1. Superduplex austenitic-ferritic steel applicable for making seamless tubes with a high mechanical strength, high pitting resistance, a good intergranular corrosion behavior and a high hot-formability, in a process comprising the following steps: meltdown in an electric-arc furnace, refining in an AOD converter, ascensional ingot casting and Gothic section billet rolling, and then transforming the billet obtained into seamless tubes by upsetting the gothic billet into a round followed by hot piercing in a vertical press, tube extrusion in a horizontal press, reduction in a stretch reduction mill and Pilger cold-rolling, essentially characterized in that the alloy is added standard elements such as C, Mn, Si, Cr, Ni, Mo, N, P, S with no Cu and W, and with the inclusion of significant quantities of B and Ca wherein the alloy has a weight percentage of C less than or equal to 0.02%, a weight percentage of Mn between 0.65% to 0.85%, a weight percentage of Si between 0.40% to 0.60%, a weight percentage of Cr between 25.2% to 25.6%, a weight percentage of Ni between 6.2% to 6.6%, a weight percentage of Mo between 3.6% to 3.8%, a weight percentage of N between 0.24% to 0.30%, a weight percentage of P less than or equal to 0.025%, a weight percentage of S less than or equal to 0.002%, a weight percentage of B between 0.0015% to 0.0030%, and a weight percentage of Ca between 0.0010to 0.005%.

2. Superduplex austenitic-ferritic steel applicable for making seamless tubes, as in all the preceding claims, wherein the resultant alloy has a composition with the following weight percentages:

C: not more than 0.02%

Mn: 0.65 to 0.85%

Si: 0.40 to 0.60%

Cr: 25.2 to 25.6%

Ni: 6.2 to 6.6%

Mo: 3.6 to 3.8%

N: 0.24 to 0.30%

P: not more than 0.025%

S: not more than 0.002%

B: 0.0015 to 0.0030%

Ca: 0.0010 to 0.0050% the remaining weight percentage being Fe and other unintentionally added impurities.

* * * * *